United States Patent [19]

Tanaka

[11] 4,161,246

[45] Jul. 17, 1979

[54] PACKAGED SLIDE FASTENER

[75] Inventor: Taruo Tanaka, 3551 Niederwalgen, Marburg am der Neuen Schule 14, Fed. Rep. of Germany

[73] Assignee: Yoshida Kogyo Kabushiki Kaisha, Tokyo, Japan

[21] Appl. No.: 913,442

[22] Filed: Jun. 7, 1978

Related U.S. Application Data

[63] Continuation of Ser. No. 748,952, Dec. 9, 1976, abandoned.

[30] Foreign Application Priority Data

Dec. 29, 1975 [JP] Japan ..... 50/177587

[51] Int. Cl.[2] ..... B65D 85/18; B65D 75/36

[52] U.S. Cl. ..... 206/45.31; 206/338; 206/294; 206/461; 206/806

[58] Field of Search ..... 206/338, 294, 292, 45.34, 206/45.31, 45.33, 461; 229/DIG. 12

[56] References Cited

U.S. PATENT DOCUMENTS

| | | | |
|---|---|---|---|
| 2,566,667 | 9/1951 | Krihwan | 206/294 |
| 2,980,245 | 4/1961 | Stoker, Jr. | 229/DIG. 12 |
| 3,066,792 | 12/1962 | Spilman et al. | 206/45.33 |
| 3,713,534 | 1/1973 | Ebata | 206/338 |

*Primary Examiner*—William T. Dixson, Jr.
*Attorney, Agent, or Firm*—Bucknam and Archer

[57] ABSTRACT

A slide fastener is placed on one surface of an elongated base plate of cardboard or plastic sheet material, the base plate being substantially coextensive in width to the slide fastener and being longer than the slide fastener. The slide fastener and the base plate are covered with an elongated plastic film having substantially the same length as the base plate and being slightly wider than the base plate. The plastic film has side margins folded back over the side edges of the base plate, the folded margins of the plastic film being bonded with an adhesive to or heat sealed to the other surface of the base plate, thereby holding the slide fastener securely in place on the base plate. The base plate has a portion of said one surface covered directly with and adhered to the plastic film, there being a cutout recess in said portion for hanging of the base plate.

4 Claims, 8 Drawing Figures

PACKAGED SLIDE FASTENER

This is a continuation, of application Ser. No. 748,952 filed Dec. 9, 1976 now abandoned.

BACKGROUND OF THE INVENTION

1. Field of the Invention

The present invention relates to a packaged slide fastener ready for sale at retail stores.

2. Prior Art

Individual slide fasteners of varying type, size and color are usually packaged and sold at retail stores to customers desiring to buy one or more fasteners which meet their requirements. One known packaged slide fastener shown in FIGS. 7 and 8 comprises an elongated carboard 10, a slide fastener 11 placed on the cardboard 10, and a transparent film 12 of plastic material covering the slide fastener 11. The cardboard 10 and the film 12 have a width greater than that of the slide fastener 11, and are bonded to each other with an adhesive along the margins 13 of the film 12 in order to enclose the slide fastener 11. With the conventional package construction, a clearance space 14 must be provided around the slide fastener 11 to prevent the latter from adhering to the cardboard 10. Therefore, the slide fastener 11 tends to shift under the plastic film 12, and finally becomes wavy or wrinkly during shipment, storage and display, thereby making the packaged slide fastener less attractive.

Furthermore, the side edges 15 of the cardboard 10 are exposed and susceptible to damage or deformation when in collision with foreign objects mainly during shipment, with the result that the plastic film is liable to peel off.

SUMMARY OF THE INVENTION

Accordingly, it is an object of the present invention to provide a packaged slide fastener in which the slide fastener can be supported stably in place within the package.

Another object of the invention is to provide a packaged slide fastener which is rigid enough to avoid any damage or deformation.

According to the invention, an elongated base plate made of cardboard or plastic sheet material carries on its one surface a slide fastener having substantially the same width as the base plate and having a length shorter than the base plate. The base plate and the slide fastener are covered with an elongated plastic film having substantially the same length as the base plate and having a width greater than that of the base plate. The plastic film has side margins folded back over the side edges of the base plate, the folded margins of the plastic film being bonded with an adhesive to or heat sealed to the other surface of the base plate. The base plate has a portion of said one surface covered directly with and adhered to the plastic film, there being a cutout recess in the portion.

Other features and advantages of the invention will become apparent from the following description taken in conjunction with the accompanying drawings.

DESCRIPTION OF THE PREFERRED EMBODIMENTS

Figure 1:
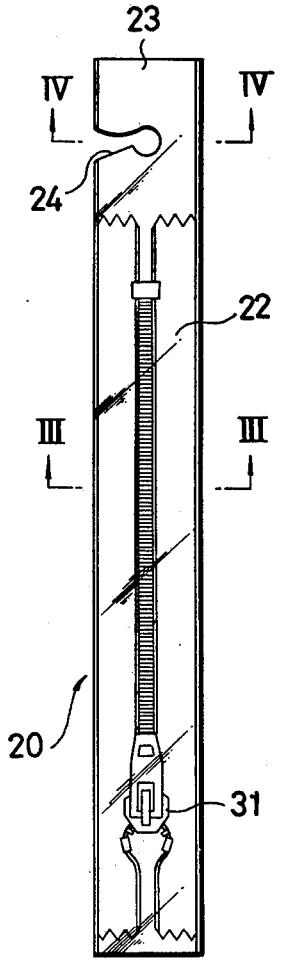
FIG. 1 is a top plan view of a packaged slide fastener constructed in accordance with the present invention.
Figure 2:
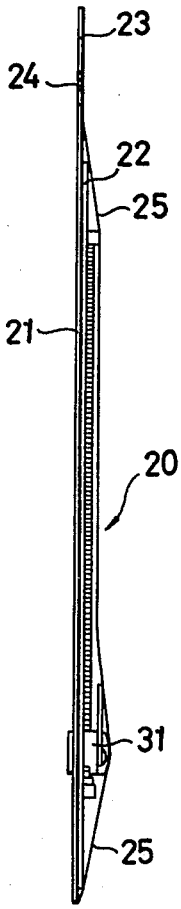
FIG. 2 is a side elevational view of the packaged slide fastener shown in FIG. 1.

In FIGS. 1 and 2, a packaged slide fastener 20 comprises an elongated base plate 21 made preferably of cardboard or plastic sheet material having substantially the same stiffness as the cardboard, and a slide fastener 22 placed on a front surface of the base plate 21. The base plate 21 has a transverse dimension or width substantially equal to or slightly narrower than the slide fastener 22 to be sold. The base plate 21 is longer than the slide fastener 22, and the length of the base plate 21 relative to that of the slide fastener 22 must be such that when the base plate 21 carries the slide fastener 22 thereon, the base plate 21 affords a portion 23 at one end of the slide fastener 22, which portion 23 is long enough to permit a cut-out recess 24 to be formed therein. The packaged slide fastener 20 can be hung down for display on a hook (not shown) extending through the recess 24.

Figure 3:
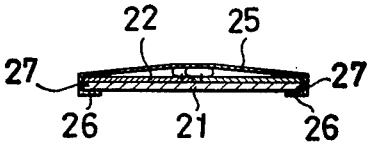
FIG. 3 is an enlarged cross-sectional view taken along line III—III of FIG. 1.
Figure 4:
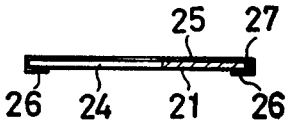
FIG. 4 is an enlarged cross-sectional view taken along line IV—IV of FIG. 1.

The base plate 21 and the slide fastener 22 thereon are covered with a plastic film 25 which is substantially coextensive in length to the base plate 21 and is greater in width than the base plate 21. As shown in FIGS. 3 and 4, side margins 26 of the plastic film 25 are folded back over the side edges 27 of the base plate 21. The folded film margins 26 are bonded to the reverse surface of the base plate with an adhesive, or are heat sealed thereto by means of a suitable heat sealing equipment, in which case the base plate, if made of cardboard, should have a porosity enabling such heat sealing. The plastic film 25 is bonded or heat sealed also to the front surface of the portion 23 of the base plate 21 for reinforcement thereof. The recess 24 is formed after the portion 23 is covered with the plastic film 25. Since the slide fastener 22 is substantially conterminous in width with the base plate 21, and has its side edges pressed against the base plate 21 by physical contact with the film 25, the slide fastener 22 is retained stably in place on the base plate 21 against displacement during shipment and display. The packaged slide fastener 20 of the invention is more attractive because an area where the plastic film 25 is adhered to the base plate 21 is not exposed to sight. The film-covered side edges 27 of the base plate 21 can be protected from damages due to physical contact with foreign objects.

The plastic film 25 is preferably transparent to allow visual inspection of the slide fastener 22 being packaged, but the film 25 may be colored provided it does not disturb such visual inspection.

Figure 5:
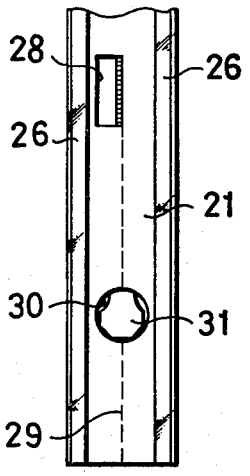
FIG. 5 is a fragmentary bottom plan view of the packaged slide fastener shown in FIG. 1.
Figure 7:
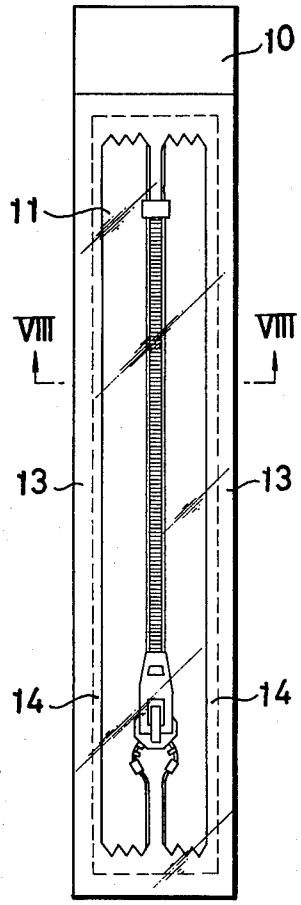
FIG. 7 is a top plan view of a conventional packaged slide fastener.

As shown in FIG. 5, the base plate 21 has an opening 28 for permitting customers, for example, to physically check or directly inspect the fastener tapes for their hue or fabric, and the fastener elements for their shape. The base plate 21 also has a perforation 29 formed therein and extending between the opening 28 and a bottom end of the base plate 21 so as to facilitate tearing of the base plate 21 along a predetermined line when the slide fastener 22 is to be taken out. There is an aperture 30 formed in the base plate 21 at a position corresponding to the slider 31 of the slide fastener 22, the aperture 30 serving to receive therein the bottom wing of the slider 31 to lock the latter in place positively and reliably.

Figure 6:
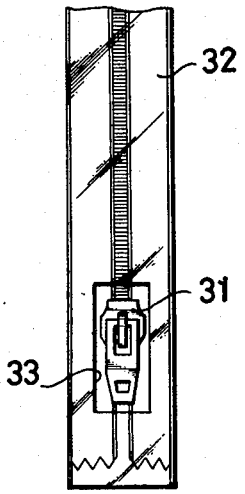
FIG. 6 is a fragmentary top plan view of a modification of the packaged slide fastener.
Figure 8:
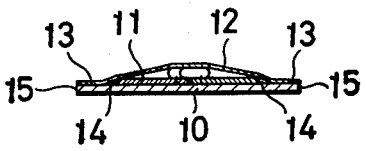
FIG. 8 is an enlarged cross-sectional view taken along line VIII—VIII of FIG. 7.

FIG. 6 illustrates an alternative form of a plastic film 32 in which a cutout 33 is provided for the slider 31 to project therethrough. With this cutout 33, the film 32 is free of localized deformations and damages which might otherwise take place with the film 25 (FIG. 2) covering the projecting slider 31. Formation of the cutout 33 is beneficial especially when the plastic film is used with a slider of high profile.

While certain specific embodiments of the invention have been described in detail, it is to be understood that various modifications may be made from the specific details described without departing form the scope of the appended claims.

I claim as my invention:

1. A packaged slide fastener comprising: an elongated base plate; a slide fastener placed on one surface of said base plate, said base plate being substantially coextensive in width to said slide fastener and having a length greater than that of said slide fastener; and an elongated plastic film having substantially the same length as said base plate and having a width greater than that of said base plate, said plastic film covering said base plate and said slide fastener thereon and having side margins folded back over the side edges of said base plate, the folded margins of said plastic film being adhered to the other surface of the base plate, said base plate having a portion of said one surface covered directly with an adhered to said plastic film, and there being a cutout recess in said portion, said base plate having an inspection opening, a perforation extending between said inspection opening and one end of said base plate, and an aperture receiving therein the bottom wing of the slider of said slide fastener.

2. A packaged slide fastener according to claim 1, said elongated base plate being made of cardboard.

3. A packaged slide fastener according to claim 1, said elongated base plate being made of plastic sheet material.

4. A packaged slide fastener according to claim 1, said elongated plastic film having a cutout through which the slider of said slide fastener projects.

* * * * *